US006149456A

United States Patent [19]

Uchiyama

[11] Patent Number: 6,149,456

[45] Date of Patent: Nov. 21, 2000

[54] CONNECTOR WITH SEALANT DEPTH INDICATOR

[75] Inventor: Takahiro Uchiyama, Yokkaichi, Japan

[73] Assignee: Sumitomo Wiring Systems, Ltd., Japan

[21] Appl. No.: 09/309,597

[22] Filed: May 11, 1999

[30] Foreign Application Priority Data

May 27, 1998 [JP] Japan ..... 10-145991

[51] Int. Cl.[7] ..... H01R 3/00

[52] U.S. Cl. ..... 439/488; 439/936; 439/948

[58] Field of Search ..... 439/936, 201, 439/521, 522, 488, 948; 174/76

[56] References Cited

U.S. PATENT DOCUMENTS

| | | | |
|---|---|---|---|
| 5,266,054 | 11/1993 | Duncan et al. . | |
| 5,630,732 | 5/1997 | Yamanashi | 439/936 |
| 5,637,007 | 6/1997 | Suzuki et al. | 439/936 |

FOREIGN PATENT DOCUMENTS

| | | |
|---|---|---|
| 0 420 413 | 4/1991 | European Pat. Off. . |
| 0 647 987 | 4/1995 | European Pat. Off. . |
| 7-11771 | 2/1995 | Japan . |
| 2257579 | 1/1993 | United Kingdom . |

*Primary Examiner*—Neil Abrams
*Assistant Examiner*—Javaid Nasri
*Attorney, Agent, or Firm*—Banner & Witcoff, Ltd.

[57] ABSTRACT

A connector can easily and reliably be checked to see whether the requisite minimum quantity of sealing compound has been injected. Tabs 14 of male terminal fittings 13 protrude from a base face of a fitting space 12. A sealing compound 20, consisting of epoxy resin or the like, is injected at the base portion of these tabs 14. A first step 15 and a second step 30 protrude into the space 12, the first step 15 being above the second step 30. After the sealing compound 20 is injected, the quantity injected is checked by observing the space 12 visually from above. If only the first step 15 is visible, the correct quantity of sealing compound 20 has been injected, if both the first step 15 and the second step 30 are visible, a quantity of the sealing compound 20 less than the minimum quantity has been injected.

6 Claims, 1 Drawing Sheet

CONNECTOR WITH SEALANT DEPTH INDICATOR

TECHNICAL FIELD

The present invention relates to an electrical connector injected with a sealing compound.

BACKGROUND OF THE INVENTION

A conventional example of this type of connector is described in JP-7-11771. As shown in FIG. 5 of this specification, this connector comprises a fitting space 2 set into one end of a connector main body 1 made from plastic, this space 2 fitting with a corresponding connector 3; and insert moulded terminal fittings 4 provided inside the main body 1, the ends thereof protruding from a base of the space 2. The base of the space 2 is injected with a sealing compound S made from epoxy resin or other material to prevent fluid transmission occurring where portions of the terminal fittings 4 pass through the space 2.

However, in order to prevent poor contact of the terminal fittings 4 with the terminal fittings of the corresponding connector 3, the maximum quantity of sealing compound S which can be injected is limited. On the other hand, the sealing compound S gradually grows weaker over time. In order to maintain the seal for a specified period, a minimum quantity of the sealing compound S must be injected in anticipation of this weakness.

The sealing compound S is inserted mechanically, using for example a nozzle, and the quantity to be injected is specified in advance. However, variations can easily occur due to factors such as injection pressure or surrounding temperature, and the prescribed quantity is not always injected. As a result, checks must be performed to discover how much has actually been injected. It is particularly difficult to see whether the minimum quantity has been injected. This is because the injected sealing compound S is located inside the space 2, and the corresponding connector 3 can be fitted irrespective of whether the minimum quantity has been injected or not. It is therefore difficult to ascertain whether the correct quantity has been injected.

The present invention has been developed after taking the above problem into consideration, and aims to present a connector which can be easily and reliably checked to see whether the minimum quantity of sealing compound has been injected.

SUMMARY OF THE INVENTION

According to the invention there is provided an electrical connector comprising a housing having a blind recess, an electrical terminal protruding from the base of said recess towards the mouth thereof, and sealant at the base of said recess to seal said terminal therein, characterised in that said housing further includes a visual indicator at a position corresponding to a predetermined depth of sealant.

Such a visual indicator allows easy inspection of the depth of sealant injected. The indicator may comprise a step in the wall of the recess, or an upstanding projection from the base thereof.

The connector may have maximum and minimum indicators comprising steps or projections of the housing. The indicator, or the outermost indicator if more than one are perovided, may also provide an insertion stop for a mating connector.

BRIEF DESCRIPTION OF DRAWINGS

Other features of the invention will be apparent from the following description of several preferred embodiments shown by way of example only in the accompanying drawings in which.

DESCRIPTION OF PREFERRED EMBODIMENT

A first embodiment of the present invention will be explained with the aid of FIGS. 1 to 3.

The present embodiment is suitable to be used for a connector of a fuel tank, both ends of this connector being provided with connecting portions for connecting with corresponding connectors, the connector being attached through the wall of the fuel tank and electrically connecting instruments at the interior and exterior of the fuel tank. The following explanation describes the configuration of the external connecting portion of this connector, this portion being injected with sealing compound.

Figure 1:
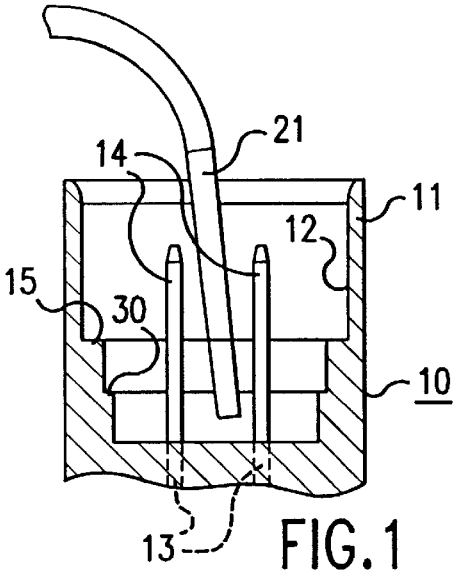
FIG. 1 is a cross-sectional view of a connector of a first embodiment of the present invention.

As shown in FIG. 1, one end of a connector main body 10 made from plastic forms an external connecting portion and is provided with a protruding hood 11. A fitting space 12 is formed in the connector main body 10 to allow a corresponding female connector (not shown) to be fitted thereto. A plurality of male terminal fittings 13 are formed in a unified manner by insert moulding within the connector main body 10, tabs 14 at one end of these male terminal fittings 13 protruding from the base of the space 12, these tabs 14 being aligned to the left and right within the space.

Occasionally, when the male terminal fittings 13 are insert moulded in the manner described above, the plastic from which the connector main body 10 is moulded does not attach well to the male terminal fittings 13, and a slight gap appears between the two. There is then the risk that fluid, etc. may leak from the fuel tank as a result of capillary action. In order to deal with this, the space 12 at the base of the tabs 14 is injected with a sealing compound 20 such as epoxy resin, thereby sealing the connector more effectively (see FIG. 2). Specifically, the tip of a nozzle 21, attached to a dispenser (not shown) capable of supplying the sealing compound, is inserted into the space 12 up to a location close to the base of the tabs 14, and a set quantity of the sealing compound 20 is injected therein by automatic control.

A first step 15 within the space 12 both regulates the insertion of the corresponding female connector and shows the maximum quantity of sealing compound 20 which can be injected therein. In this case, the maximum quantity of sealing compound 20 which can be injected is that which allows the corresponding female connector to be fitted in a stable manner. If a greater quantity of sealing compound 20 is injected, the female connector cannot be fitted correctly, and there is a risk that excess sealing compound 20 would adhere to the tabs 14 and prevent them from making proper contact with the corresponding female terminal fittings.

A second step 30 is provided further towards the interior of the space 12 relative to the first step 15, and this second step 30 protrudes further inwards. The second step 30 can easily be visually observed from the top of the space 12, and the height from the base face of the space 12 to the second step 30 corresponds to the minimum quantity of sealing compound 20 which must be injected. In this case, the minimum quantity to be injected is that which takes into account the deterioration of the sealing compound 20 over time, and which is necessary to prevent the connector from leaking for a prescribed period.

In use, the nozzle 21 is inserted into the space 12 between the left and right tabs 14 of the male terminal fittings 13, the tip of the nozzle 21 being located at a position close to the base of the tabs 14, and filling with the sealing compound 20 is begun. When it is detected by automatic control that a specified quantity of the sealing compound 20 has been injected therein, the injection is completed. In this manner, the correct quantity of sealing compound 20, i.e. a quantity between the maximum and minimum quantities, is injected into the space 12.

Figure 2:
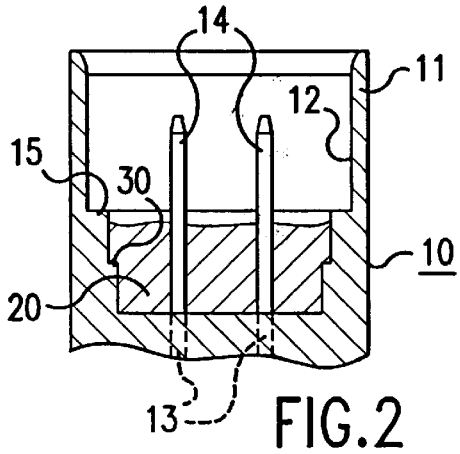
FIG. 2 is a cross-sectional view showing a correct quantity of a sealing compound having been injected.

As shown in FIG. 2, when the correct amount of sealing compound 20 has been injected and the space 12 is checked visually above, the first step 15 can be seen, but the second step 30 has been covered by the sealing compound 20, and cannot be seen. It is therefore possible to detect whether the correct quantity of sealing compound 20 has been injected.

However, the quantity of sealing compound 20 actually injected can easily vary due to factors such as injection pressure or surrounding temperature, etc. These are difficult to control, and a certain number of cases occur in which an excess or insufficient quantity is injected.

Figure 3:
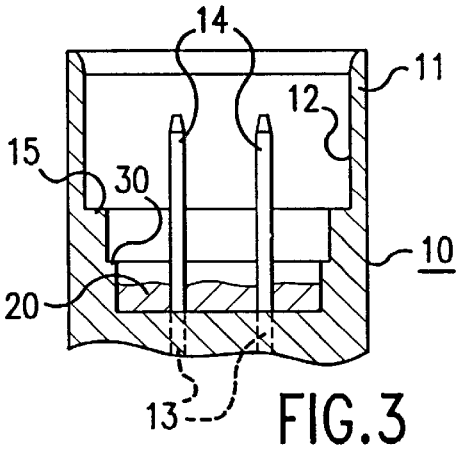
FIG. 3 is a cross-sectional view showing a quantity less than the minimum quantity of the sealing compound having been injected.

FIG. 3 shows a case in which, due to factors influencing the injection process, a quantity less than the minimum quantity of sealing compound 20 has been injected. When the connector is checked by visually examining the space 12 from above, both the first step and the second step 30 can be seen. As a result, the fact that a quantity less than the minimum quantity of sealing compound 20 has been injected is easily detected, and the connector will be rejected as defective.

Further, in the case where an excess quantity of the sealing compound 20 has been injected, neither the first step 15 nor the second step 30 can be seen when the space 12 is visually examined from above, and consequently the connector will be rejected as defective.

According to the embodiment explained above, the second step 30 protrudes and shows that a quantity less than the minimum quantity of sealing compound 20 has been injected. It is consequently simple to ascertain, by examining the space 12 visually from above, whether the second step 30 is covered or not, thereby easily checking the connector to see whether the quantity of sealing compound 20 is below the minimum quantity.

Next, a second embodiment of the present invention will be explained with the aid of FIG. 4.

In the first embodiment, a step is formed within the space 12 to indicate the minimum quantity of sealing compound 20 to be injected. In the present embodiment, a column is used as an indicator.

Figure 4:
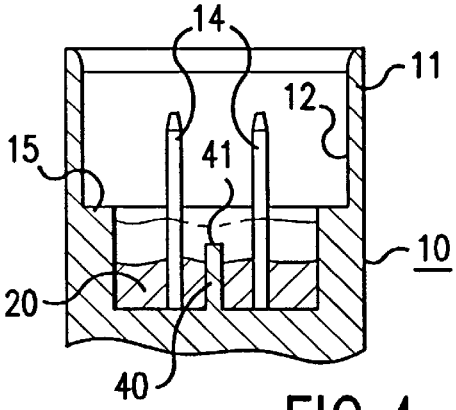
FIG. 4 is a cross-sectional view of a connector of a second embodiment of the present invention.
Figure 5:
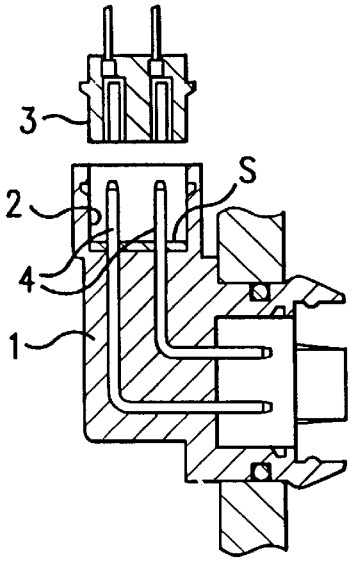
FIG.5 PRIOR ART
FIG. 5 is a cross-sectional view of a prior art example.

As FIG. 4 shows, a cylindrical column 40 protrudes from the lower face of the space 12 between the left and right tabs 14, an upper face 41 of this column 40 being flat. The height of the column 40 is identical with that of the second step 30 of the first embodiment, and corresponds to the minimum quantity of the sealing compound 20.

The remaining configuration is identical with that of the first embodiment, and components having the same function have been accorded the same numbers as in the first embodiment. Accordingly, an explanation thereof is omitted.

The space 12 is visually examined from above to check the quantity of sealing compound 20 which has been injected and, as in the case of the first step 15 in the first embodiment, it can be ascertained that the correct quantity of sealing compound 20 has been injected if the upper face 41 of the column 40 is covered. This quantity is represented by the two-dot chain line in FIG. 4. Furthermore, it can be ascertained that a quantity of the sealing compound 20 less than the minimum quantity has been injected if both the first step 15 and the upper face 41 of the column 40 can be seen. This quantity is represented by the continuous line in FIG. 4.

OTHER EMBODIMENTS

The present invention is not limited to the embodiments described above with the aid of figures. For example, the possibilities described below also lie within the technical range of the present invention. In addition, the present invention may be embodied in various other ways without deviating from the scope thereof.

(1) A column with a flat upper face may equally well be used as an indicator of the maximum quantity to be injected as well as the minimum quantity, this column having the same height as the first step.

(2) Instead of the steps and columns described in the above embodiments, two other indicators may equally well be used, such as protrusions, grooves, etc. provided on the side walls of the fitting groove.

(3) The above embodiments refer to a connector for a fuel tank, However, the present invention is equally suitable for use in other connectors having a fitting groove which requires the injection of a sealing compound. A bulb socket provided with a connector is an example.

(4) In the above embodiments, the terminal fittings of the connector are provided therein by insert moulding. However, connectors in which through-type terminal fittings are press-fitted after the connector main body has been moulded are also equally suitable.

What is claimed is:

1. A connector comprising a housing body having an engagement recess for accommodating a mating connector, said engagement recess comprising an open end through which the mating connector is received, a bottom wall, one or more side walls extending from said bottom wall, and a shoulder on an interior surface of said side walls, said engagement recess further comprising:

at least one electrical terminal projecting from said bottom wall toward said open end, said electrical terminal having a contact portion projecting above the shoulder, a sealant to seal said electrical terminal within the engagement recess, and a minimum depth indicator having a indicating surface oriented substantially perpendicular to the projecting electrical terminal, the indicating surface being formed above said bottom wall and below said shoulder for indicating that a predetermined minimum depth of sealant has been filled therein, the indicating surface of the minimum depth indicator being substantially covered when the predetermined minimum depth of sealant is filled.

2. The connector according to claim 1, wherein said shoulder comprises a maximum depth indicator for indicating a predetermined maximum depth of sealant.

3. The connector according to claim 2, wherein said shoulder is an insertion step for the mating connector.

4. The connector according to claim 1, wherein said minimum depth indicator is upstanding from said bottom wall.

5. The connector according to claim 1, wherein said minimum depth indicator comprises a step on said side walls.

6. The connector according to claim 5, wherein said step extends continuously around the entire recess.

* * * * *